US007500573B1

(12) United States Patent
Flynn

(10) Patent No.: US 7,500,573 B1
(45) Date of Patent: Mar. 10, 2009

(54) SADDLE RACK AND HARNESS RACK LIFT

(76) Inventor: James T. Flynn, 9163 Weld County Road 28, Platteville, CO (US) 80651

( * ) Notice: Subject to any disclaimer, the term of this patent is extended or adjusted under 35 U.S.C. 154(b) by 401 days.

(21) Appl. No.: 11/300,629

(22) Filed: Dec. 14, 2005

Related U.S. Application Data

(60) Provisional application No. 60/645,779, filed on Jan. 21, 2005.

(51) Int. Cl.
*A47F 7/00* (2006.01)

(52) U.S. Cl. ..... 211/85.11

(58) Field of Classification Search ..... 211/85.11, 211/1.51, 1.57; 108/94–96, 102, 103, 105, 108/108, 141, 147.11, 106
See application file for complete search history.

(56) References Cited

U.S. PATENT DOCUMENTS

D42,635 S 6/1912 Lack et al.
2,809,755 A * 10/1957 Martorello ..... 211/85.11
3,294,267 A 12/1966 Schweigert
3,315,819 A 4/1967 Kingsbery
3,662,909 A 5/1972 Cherry
3,811,574 A * 5/1974 O'Brien ..... 211/85.11
3,940,174 A * 2/1976 Mayes ..... 296/3
D255,611 S 6/1980 Love
4,329,928 A * 5/1982 Shaw ..... 108/106
5,362,078 A 11/1994 Paton
5,615,783 A * 4/1997 Warnken ..... 211/118
5,950,846 A * 9/1999 Duane ..... 211/175
6,189,706 B1 * 2/2001 Akins ..... 211/87.01
6,659,476 B2 * 12/2003 Weida ..... 280/47.19
2004/0182803 A1 9/2004 Lay et al.

* cited by examiner

*Primary Examiner*—Sarah Purol
(74) *Attorney, Agent, or Firm*—Rick Martin; Patent Law Offices of Rick Martin, P.C.

(57) ABSTRACT

Heavy saddles can be loaded at waist height onto a vertical array of saddle racks. The vertical array is mounted on a central post containing a powered gear which lifts in sequence first the uppermost saddle rack and then each one below. A trailer model provides a swing out chassis for the central post with a load position and a storage position. A non-pivoting embodiment is shown. A retail store tree style lift rack is also shown as is a harness rack version.

12 Claims, 12 Drawing Sheets

SADDLE RACK AND HARNESS RACK LIFT

CROSS REFERENCE APPLICATIONS

This application is a non-provisional application claiming the benefits of provisional application No. 60/645,779 filed Jan. 21, 2005.

FIELD OF INVENTION

The present invention relates to providing a series of waist high saddle racks to accommodate easy loading, wherein each saddle can be raised/lowered on a pole for convenience of storage. Some models fit in a horse trailer, others in a store.

BACKGROUND OF THE INVENTION

Horse trailers can carry a tack room for transporting four or more saddles. FIG. 1B (prior art) shows a horse trailer 1 having a tack room doorway 2. A rear wall 3 has four permanently mounted saddle racks 4, 5, 6, 7. The horseman has to physically lift a saddle up onto racks 5, 6, 7 wherein rack 4 is about at waist height.

U.S. Pat. No. 3,294,267 (1966) to Schweigert discloses a tack room ceiling mounted saddle rack that provides the rack to slide outside the tack room door at about waist height for loading two saddles. No lifting of a saddle to a higher storage position is suggested in this nor any known prior art reference.

Below follows a brief description of the related art.

U.S. Pat. No. 2,809,755 (1957) to Martorello discloses a single saddle stationary rack bolted to a closet floor.

U.S. Pat. No. 3,294,267 (1966) to Schwiegert discloses two saddle racks mounted from a closet ceiling bracket, wherein the rack slides out of the trailer for loading.

U.S. Pat. No. 3,315,819 (1967) to Kingsbery discloses a tree stand for saddles.

U.S. Pat. No. 3,662,909 (1972) to Cherry discloses a ceiling mounted bracket which supports a slidable saddle rack.

U.S. Pat. No. 3,811,574 (1974) to O'Brien discloses a ceiling mounted bracket for a slidable saddle rack.

U.S. Pat. No. 5,362,078 (1994) to Paton discloses a hard truck and saddle stand combination.

U.S. Pat. No. 5,615,783 (1997) to Warnken discloses a fold out stationary saddle rack.

U.S. Pat. No. 6,189,706 (2001) to Akins discloses a stationary blanket rack.

U.S. Pat. No. 6,659,476 (2003) to Weida discloses a hard truck and rack combo.

U.S. Pat. No. Des. 42,635 (1912) to Lack discloses a stationary hanging rack.

U.S. Pat No. Des. 255,611 (1980) to Love discloses a hand truck and rack combo.

U.S. Pat. Pub. No. US 2004/0182803 Lay discloses a sliding wall mounted rack.

What is needed in the art is a mechanism to allow waist level loading of a saddle onto a rack, wherein the rack is then lifted up to a storage position, and then lowered when unloading is needed.

The present invention provides a motorized four or more saddle rack that allows loading four saddles at waist height. Each saddle after loading is raised up a pole that supports the rack. The racks can also pivot 1800 for storage in the tack room.

SUMMARY OF THE INVENTION

An aspect of the present invention is to provide in the preferred embodiment a mounting pole inside the doorway of a trailer tack room.

Another aspect of the present invention is to provide a pivotable rack lifting mechanism mounted to the mounting pole.

Another aspect of the present invention is to provide a sequential one rack at a time lifting sequence for the racks.

Another aspect of the present invention is to provide a retail store tree stand version of the invention.

Another aspect of the present invention is to provide a non-pivoting version of the lift.

Other aspects of this invention will appear from the following description and appended claims, reference being made to the accompanying drawings forming a part of this specification wherein like reference characters designate corresponding parts in the several views.

The lift assembly consist of a hollow tube having a powered, threaded bolt therein. A lifting nut raises/lowers a top rack collar that slides up and down the tube. Connectors couple each succeeding rack collar to one another. When the top rack collar raises a few inches it starts to pull the second rack collar up, and so on. The motor is geared to provide a relatively slow lift operation for two reasons. The first reason is safety so that workers do not catch their fingers in moving parts. The second reason is there exists a usual delay to fetch one saddle and then the next before loading is possible. Once the maximum number of saddles are loaded (four or more are possible), then the tube is pivoted inside the tack room for storage.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1A:
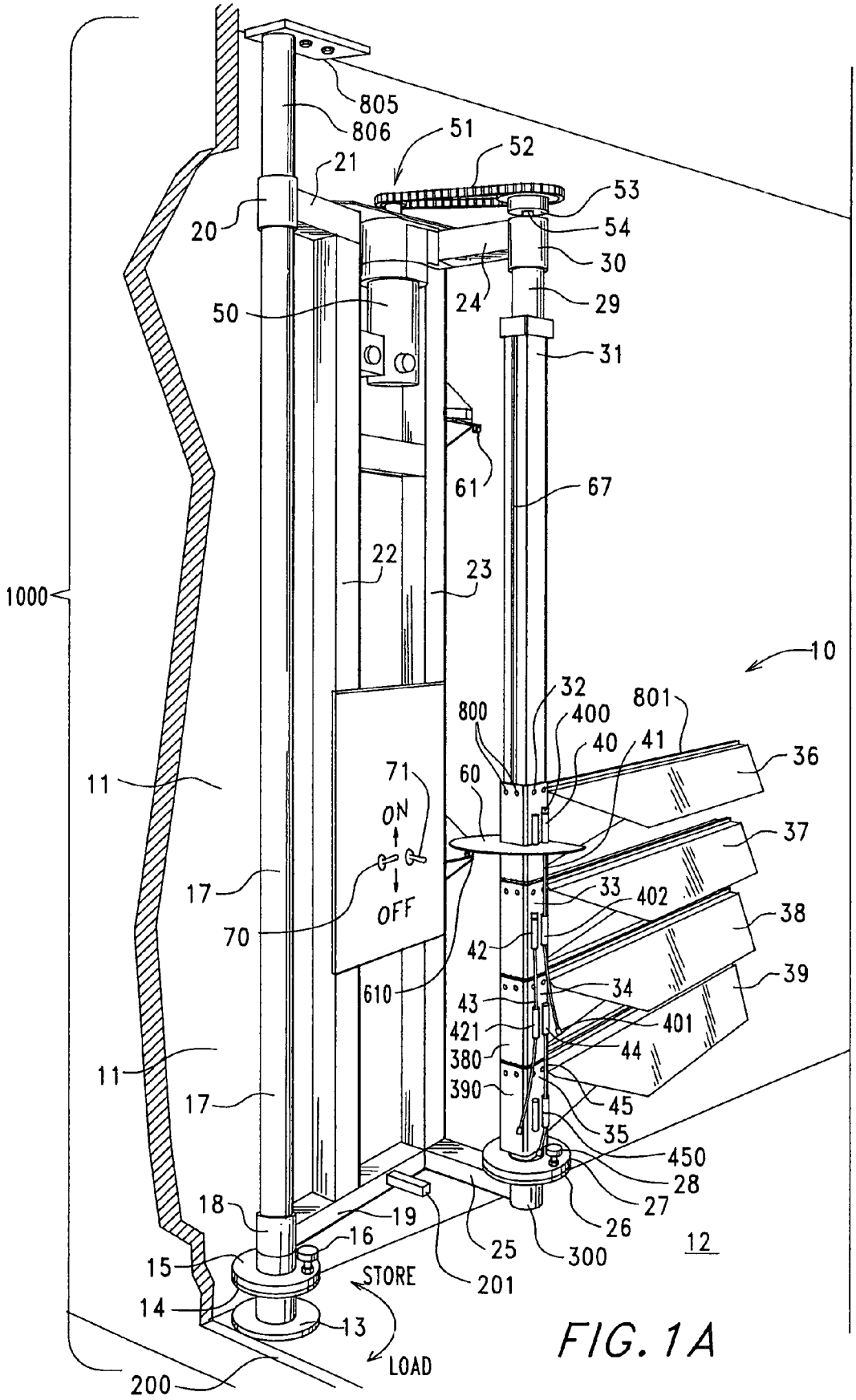
FIG. 1A is a side perspective view of the preferred embodiment trailer tack room mounted saddle rack. (prior art)
Figure 1B:
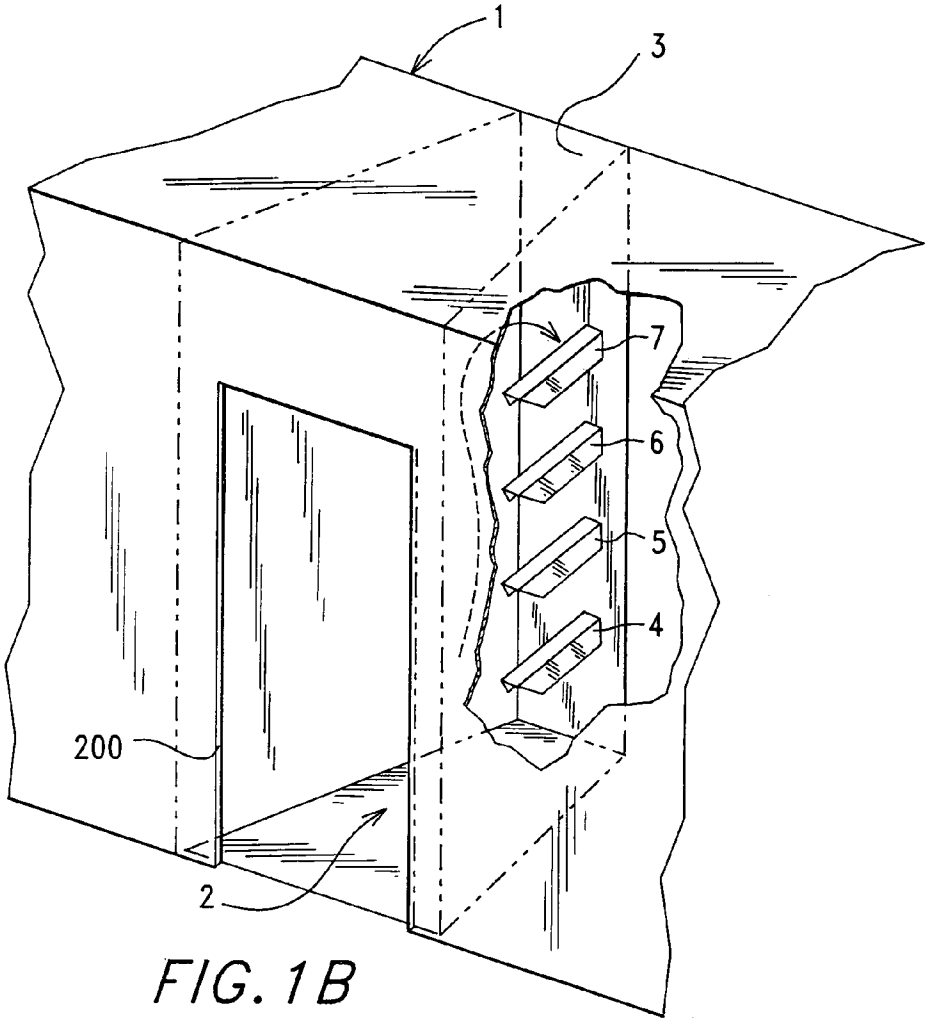
FIG. 1B (PRIOR ART)
FIG. 1B is a schematic view of a known four saddle tack room shelf.
Figure 6:
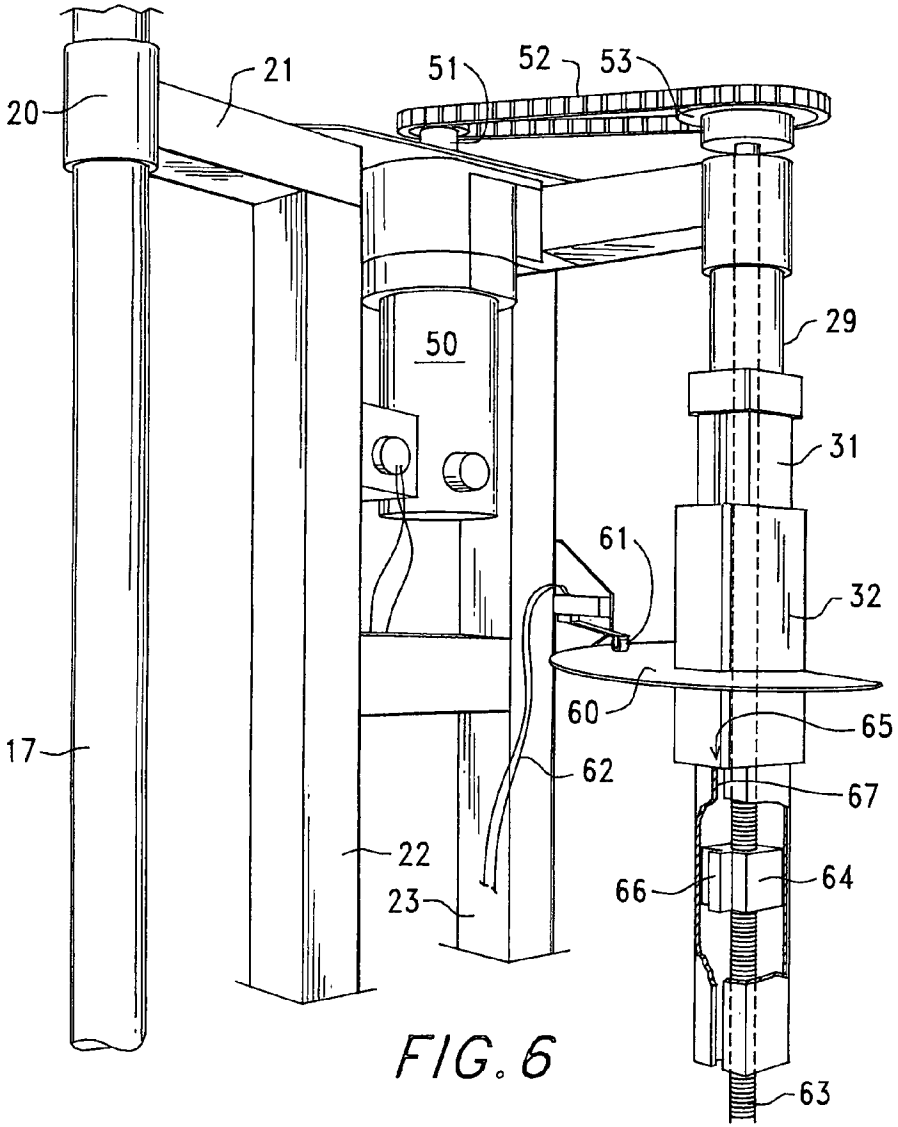
FIG. 6 is a perspective view of the motor, the tube and the top rack collar hitting the shut off switch.

Referring first to FIGS. 1A, 6 a trailer tack room 10 has a floor 12 and left side wall 11. The saddle lift 1000 has an anchor 13 fastened on the floor 12. The anchor 13 supports a stationary tube 17 which has a lower collar 18 welded to a flange 15 that rotates. The anchor 13 has an upper flange 14 with locking holes to accept locking pin 16, thereby locking the horizontal braces 19, 21 at a desired position along the arc shown by arrows load and store. Ceiling anchor 805 supports a support rod 806 which keeps tube 17 stationary.

The tube 17 collars 18, 20 rotate around tube 17 and support horizontal braces 19, 21 which support vertical frame posts 22, 23. Brackets 24, 25 are set at an approximate 90° angle to their respective support brackets 21, 19 in order to further support a rotatable tube 29 via collars 30, 300. Collar 300 has a flange 26 with holes to accept locking pin 28 on flange 27 to provide a desired rotational angle for the tube 29.

A square strut 31 is connected to the tube 29. A slot 67 in the strut 31 allows the tooth 66 of lifting nut 64 to lift the upper rack collar 32 at point 65. A threaded bolt 63 is powered by bi-directional motor 50 via gears 51, 53 and chain 52. In FIG. 6*a* micro switch 61 has been contacted by upper rack collar flange 60, thereby stopping motor 50 via wires 62. In FIG. 1A flange 60 has shut off motor 50 by contacting micro switch 610. Up/Down switch 70, and on/off switch 71 control the motor 50.

The upper rack collar 32 supports saddle rack 36. A tubular stop 40 raises the head 400 of cable 41 as the upper rack collar 32 is powered upward. The head 401 of cable 41 locks against tubular stop 402 on rack collar 33 thereby lifting rack collar 33 up with rack collar 32. In a like manner the rack collars 380, 390 are lifted by locks 42, 421, 44, 450 and cables 43, 45. As the motor 50 is reversed to lower lifting nut 64, the cables 41, 43, 45 lower their respective rack collars.

Saddle racks 36, 37, 38, 39 are supported by the respective rack collars 32, 33, 380, 390. Friction reducing screws 800 (preferably nylon) provide sliding friction reduction between the rack collars and the strut 31. The raised brace 801 prevents the saddle from slipping sideways.

Figure 8:
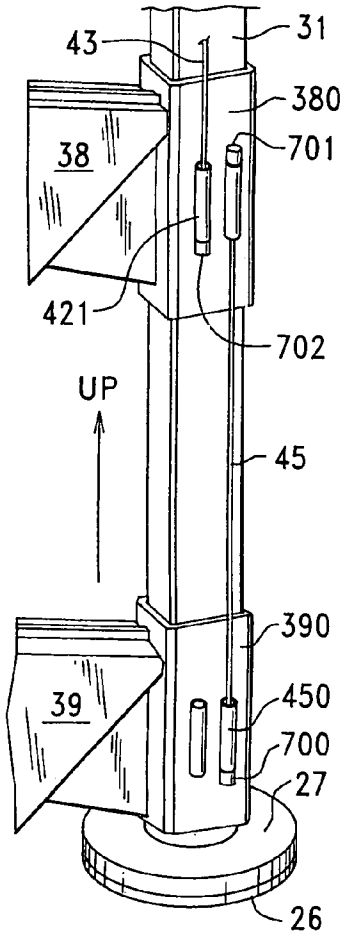
FIG. 8 is the same view as FIG. 7 with the upper rack collar lifting the lowest rack collar via the connecting wire.
Figure 7:
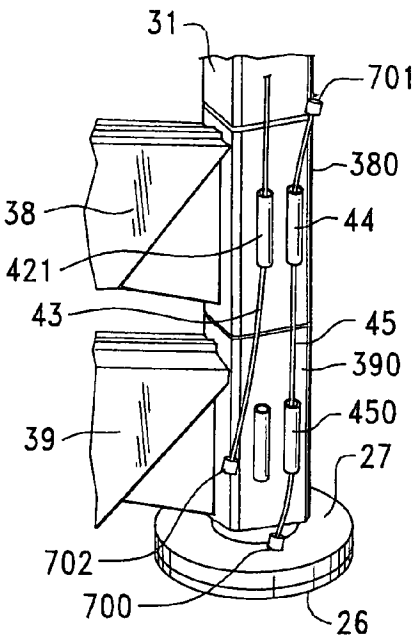
FIG. 7 is a side perspective view of the bottom two rack collars nested on the bottom of the tube, showing the connecting lift wires.

Referring next to FIGS. 7, 8 rack collar 380 is seen lifting lowermost rack collar 390 via head 700 locking into tubular lock 450 via cable 45. Arrow UP shows how cable 43 is lifting rack collar 380 via head 702 locking into tubular lock 421.

Figure 2:
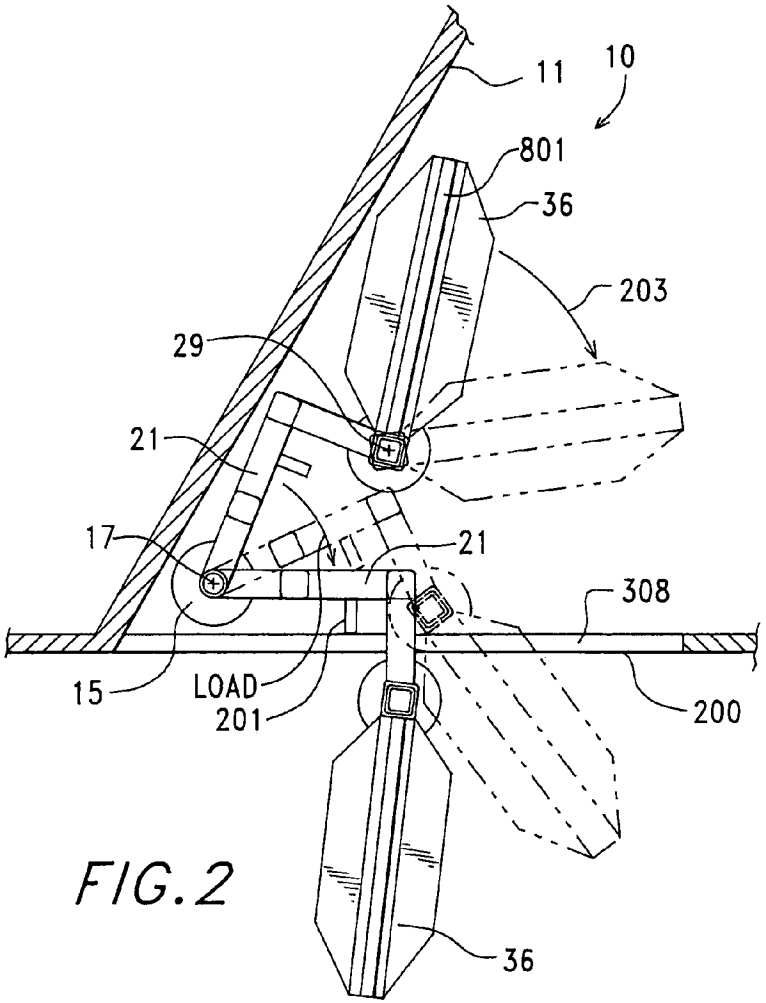
FIG. 2 is a top plan view of the FIG. 1A device in action.

Referring next to FIG. 2 horizontal brace 21 has been moved away from wall 11 in the load direction until stop 201 hits a door jam at door 200. Either before or after the rotation of horizontal brace 21, the saddle rack 36 along with all the saddle racks beneath it may be rotated to the load/unload position indicated by arrow 203. The dotted outlines show the respective members in movement. Clearly a mirror image of the system could be used for a right hand hinged door.

Figure 3:
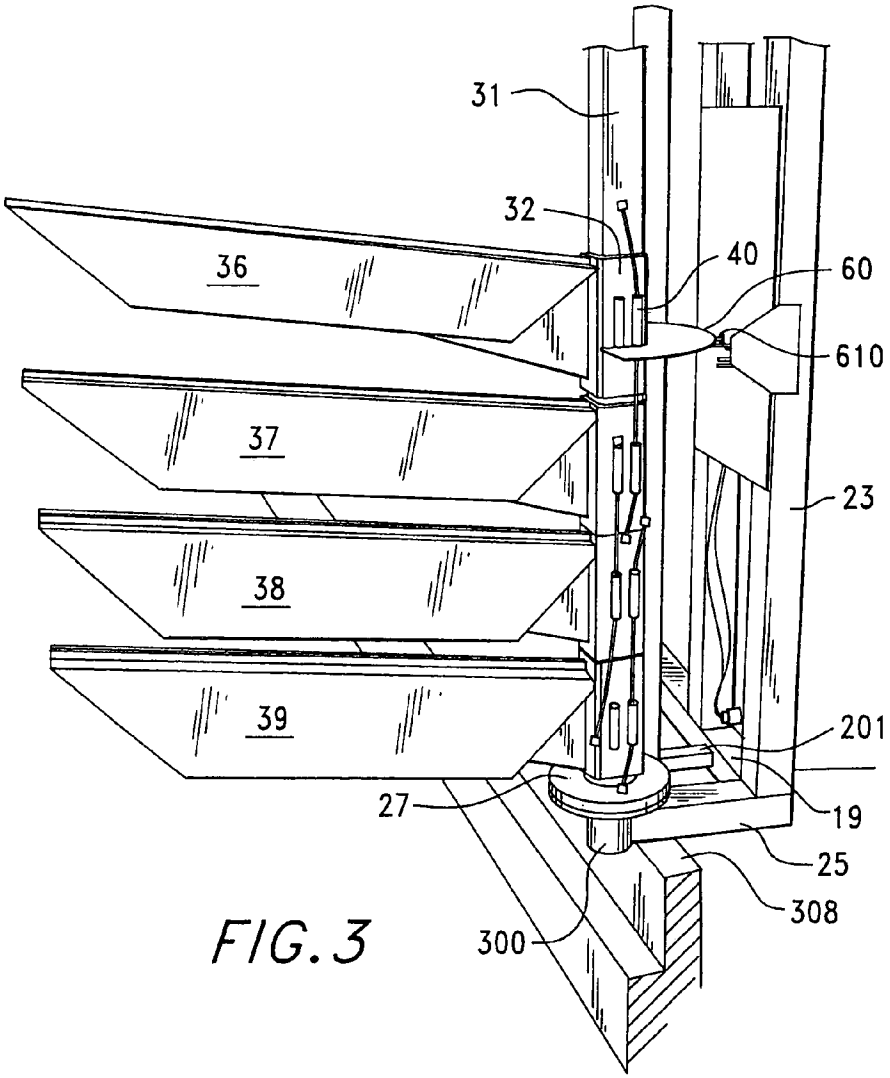
FIG. 3 is a side perspective view of the FIG. 1A device pivoted outside the tack room, ready to load the first saddle at about waist height.

Referring next to FIG. 3 the door jam 308 has stopped the stop 201. The saddle racks 36, 37, 38, 39 are ready for loading, wherein the first saddle is loaded on saddle rack 36 at about waist height.

Figure 4:
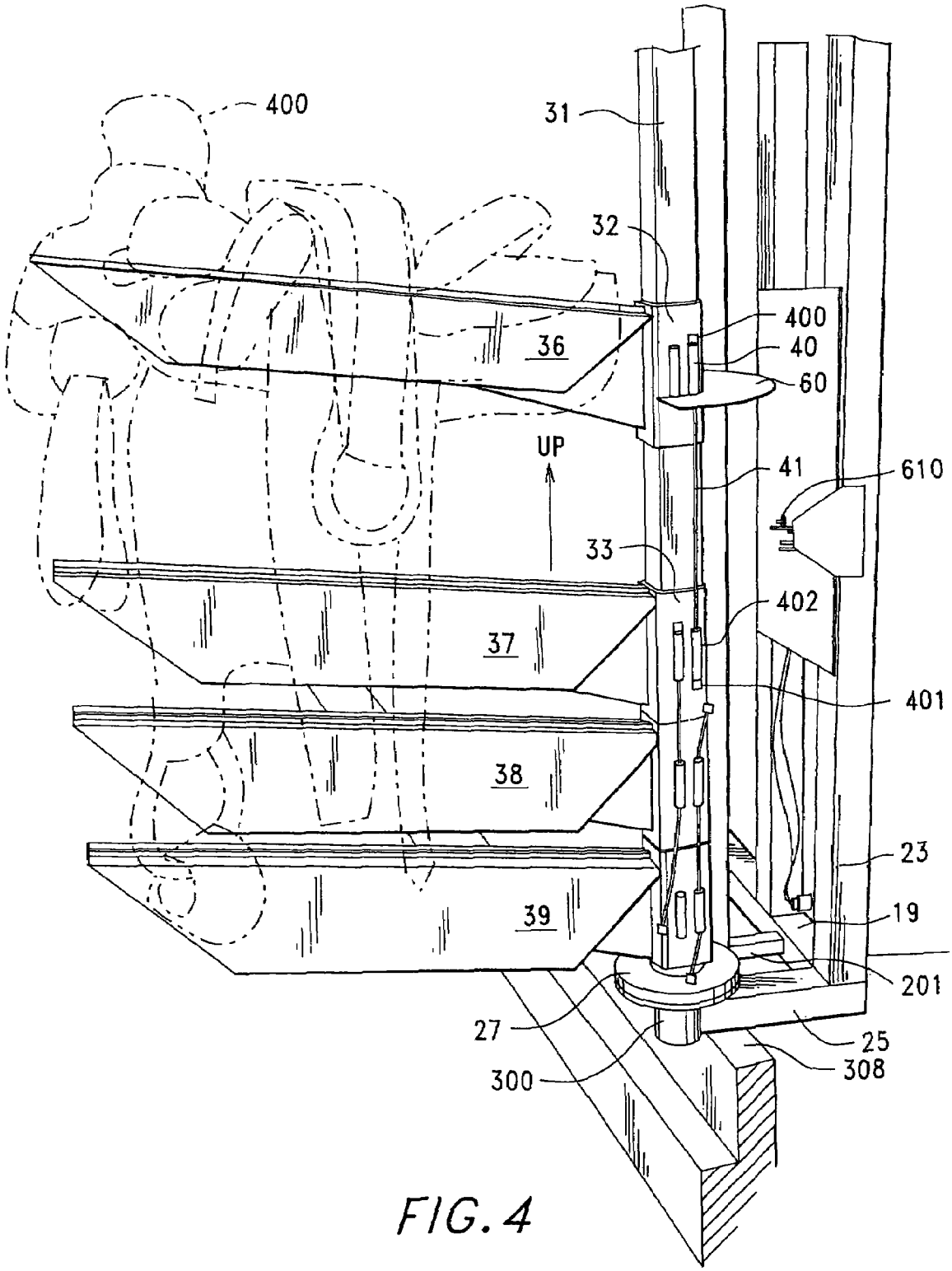
FIG. 4 is the same view as FIG. 3 with the first saddle loaded and lifted.

Referring next to FIG. 4 saddle 400 is now lifted UP enough to load the next saddle (not shown). Cable 41 is starting to lift rack collar 33 via locks 40, 402 and cable heads 400, 401.

Figure 5:
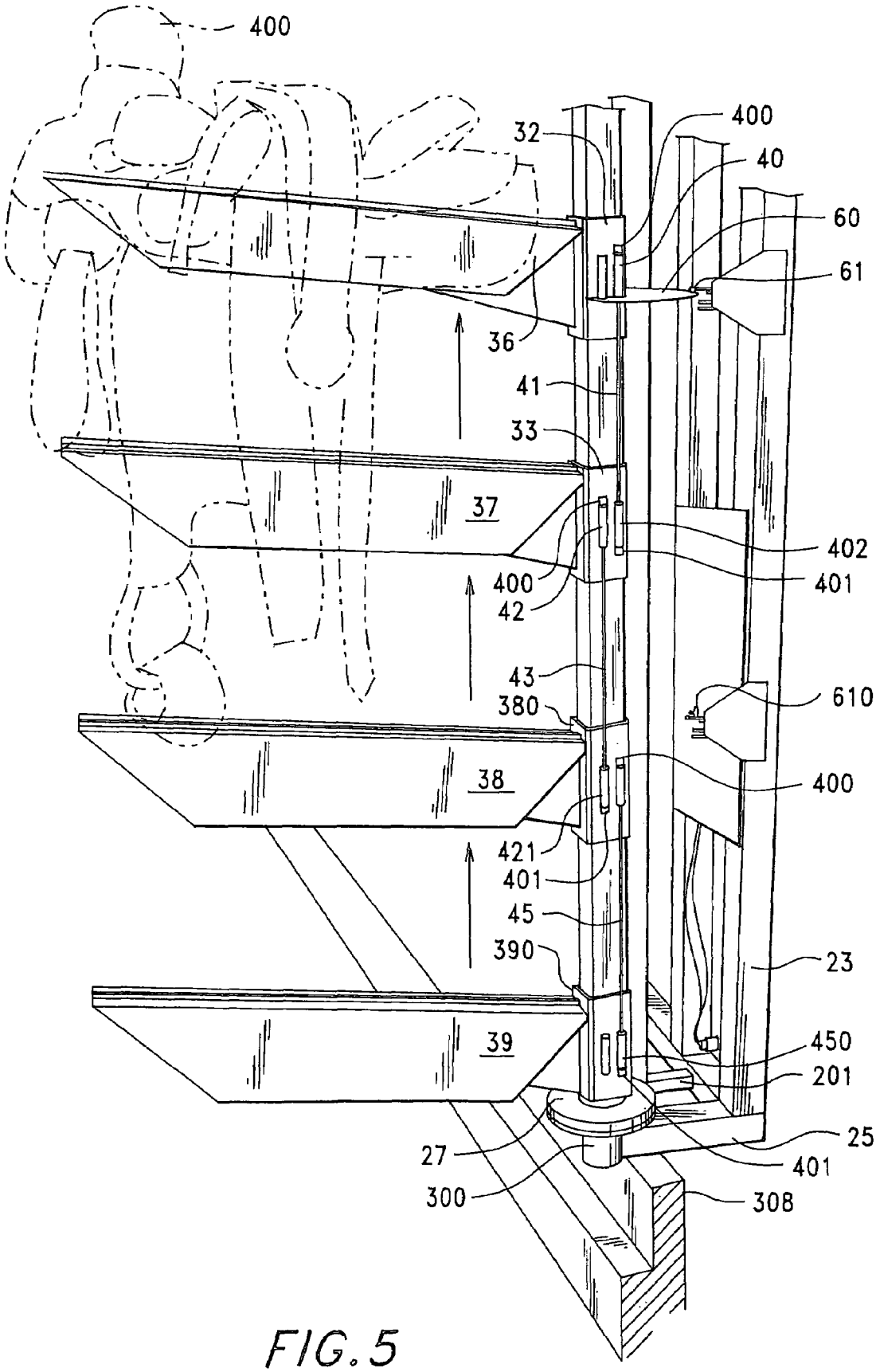
FIG. 5 is the same view as FIG. 3 with the lift fully raised.

Referring next to FIG. 5 in operation a saddle would normally have been loaded on upper three racks 36, 37, 38. Saddle rack 39 would be ready to load. The designer can choose how high and/or whether to lift saddle rack 39 via cable 45. Clearance for a saddle is needed above the floor 12.

Figure 9:
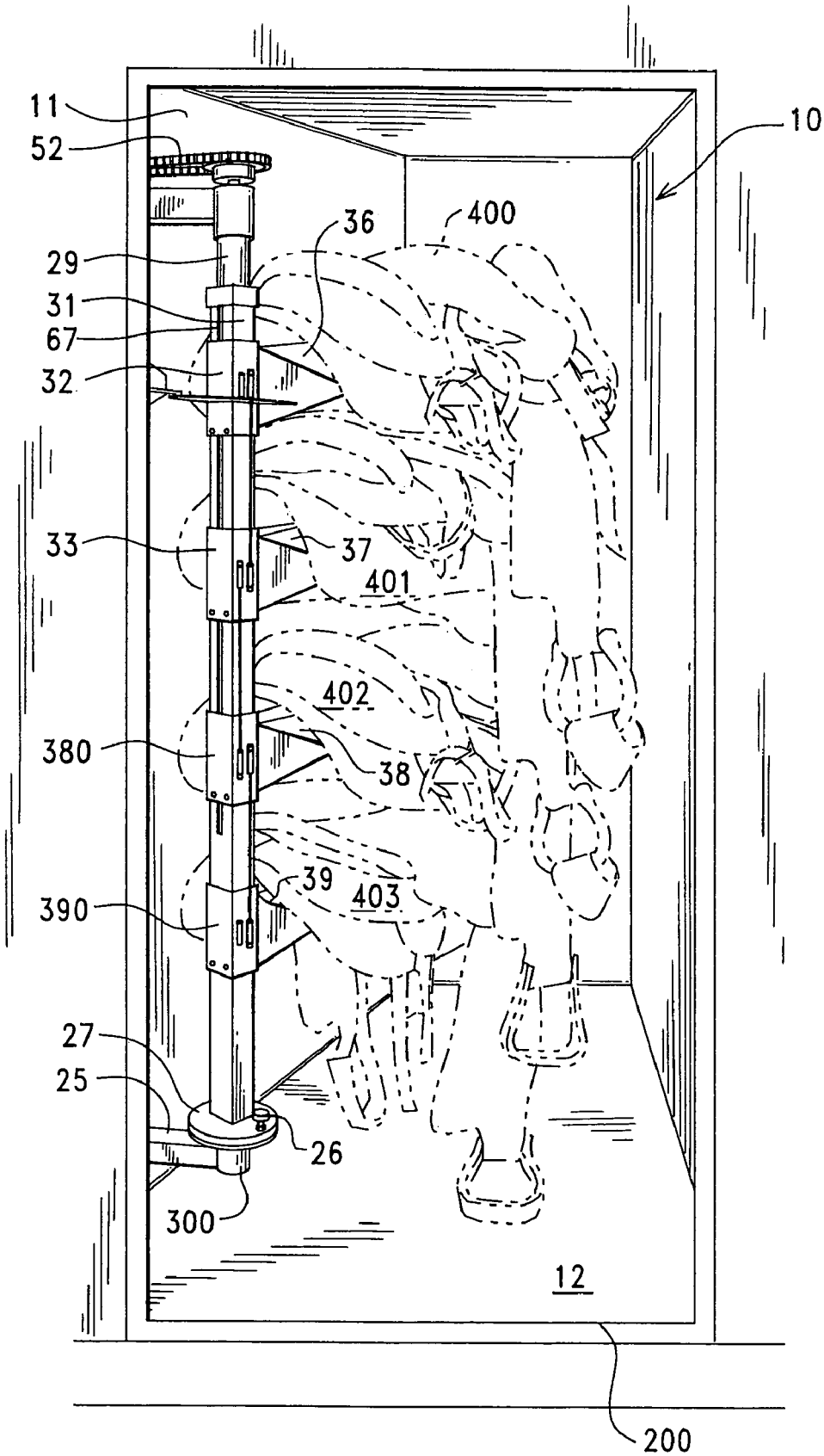
FIG. 9 is a side perspective view of four saddles stored on the device inside the tack room.

Referring next to FIG. 9 form saddles 400 to 403. are now loaded on saddle racks 36-39. Pin 28 has locked the square strut 31 in the storage position.

Figure 10:
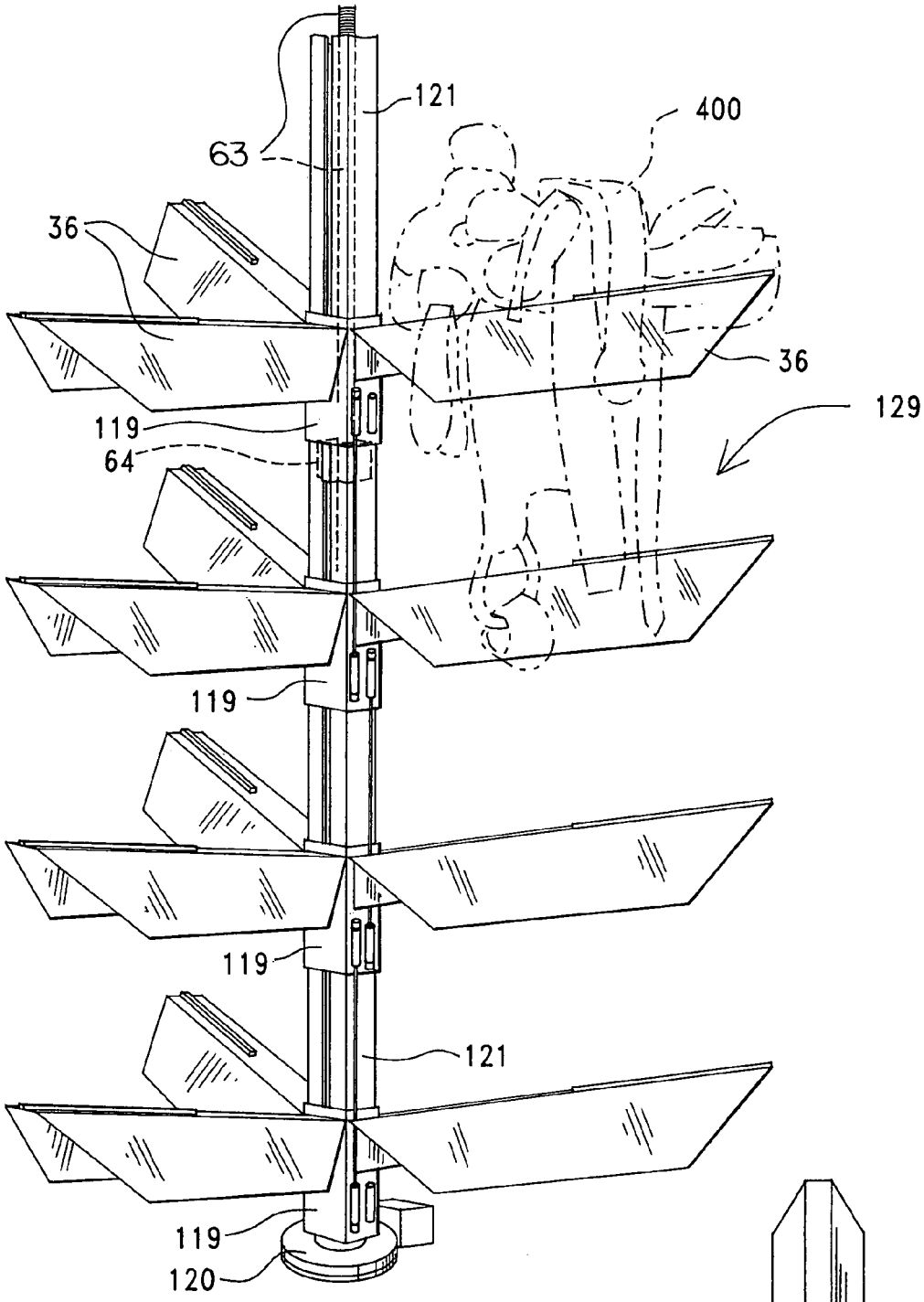
FIG. 10 is a side perspective view of a retail store tree type embodiment.
Figure 11:
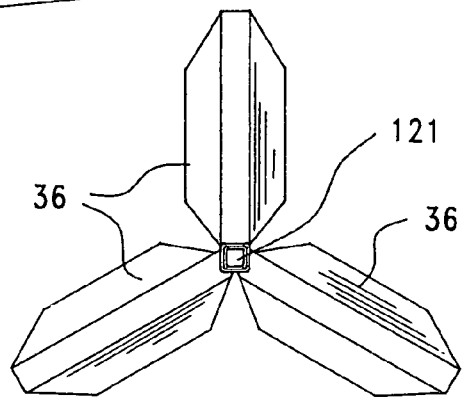
FIG. 11 is a top plan view of the FIG. 10 embodiment.

Referring next to FIGS. 10, 11 the retail store saddle lift 129 has an anchor 120 connected to the floor. The square strut 121 functions the same as strut 31 of FIG. 1A. Each rack collar 119 supports three (or from 2-4) saddle racks 36. The same lifting nut 64 raises/lowers the uppermost rack collar. The tubular cable locks and cables and groove not seen as they are in the rear.

Figure 12:
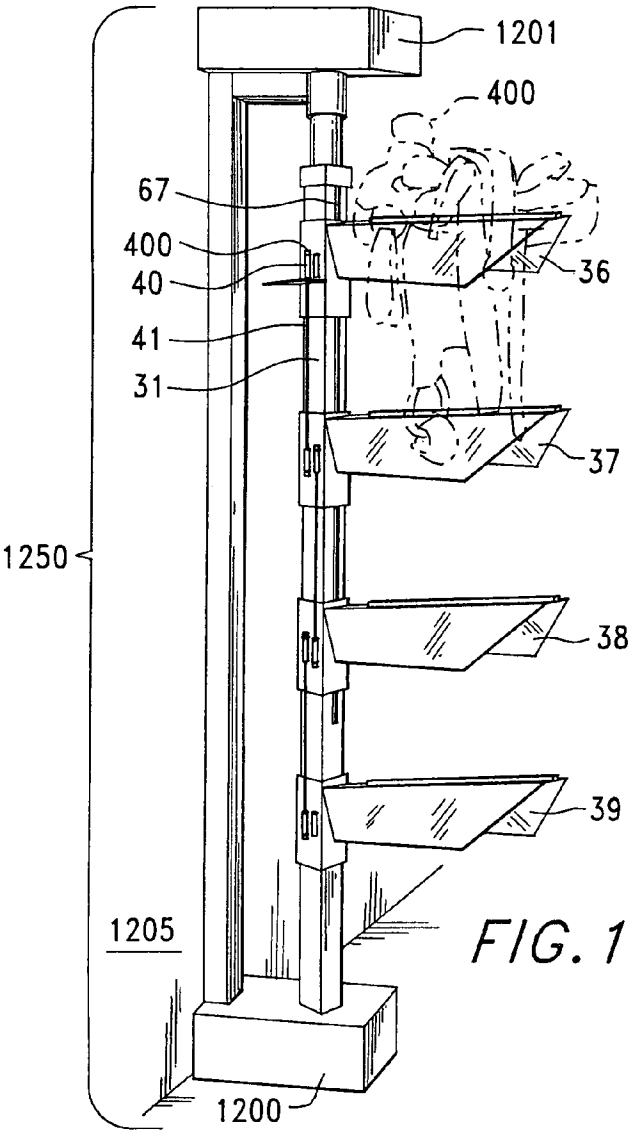
FIG. 12 is a side perspective view of a non-pivoting saddle rack lift device.

Referring next to FIG. 12 a non-pivotable saddle lift 1250 can be mounted against any wall 1205. An anchor 1200 and a brace 1201 support the square strut 31. The functionality of the system 1000 of FIG. 1A is the same, except strut 31 remains fixed.

Design choice can be used to power the various motors which could be DC motors for trailer systems, and AC motors for room systems.

Figure 14:
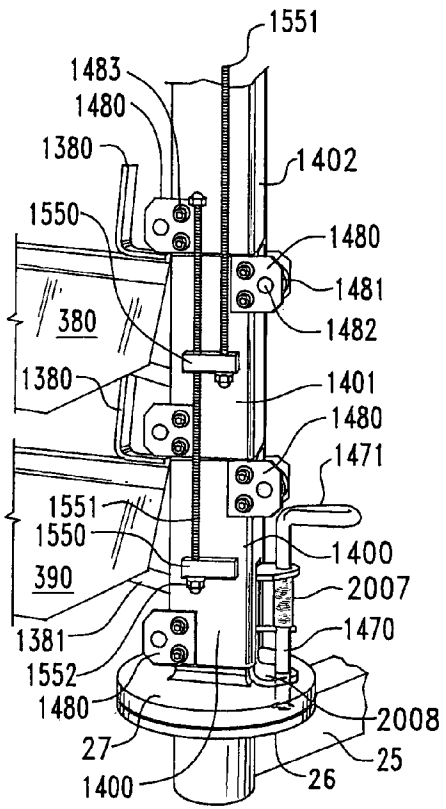
FIG. 14 is a close up side perspective view of the FIG. 13 embodiment.
Figure 13:
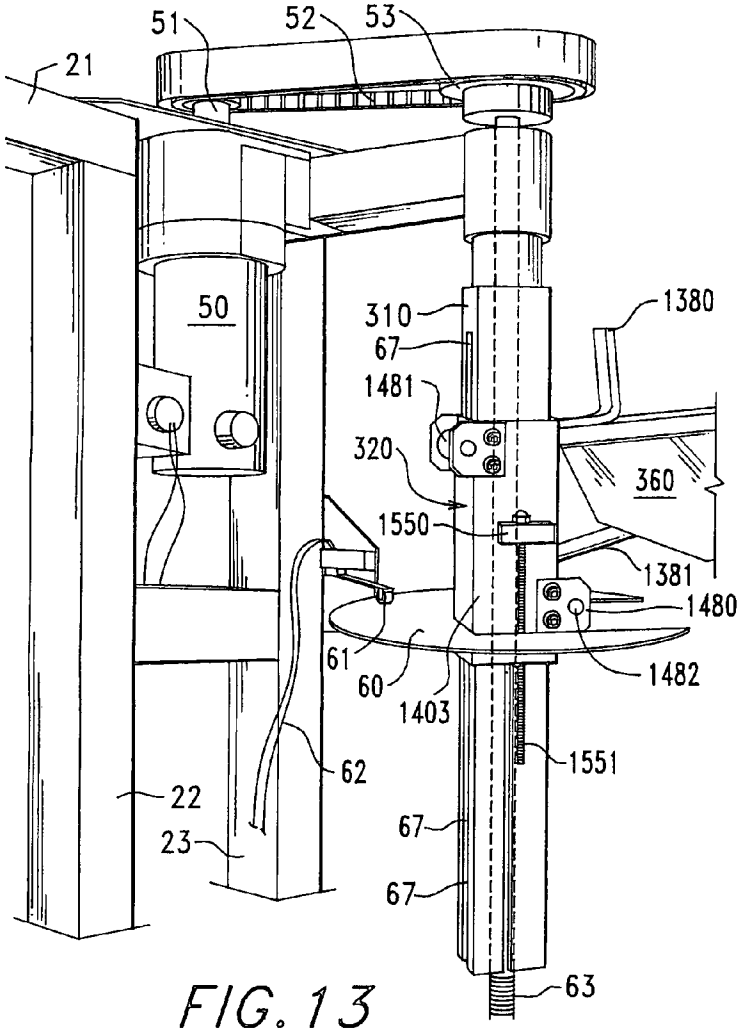
FIG. 13 is a side perspective view of an alternate embodiment saddle rack collar assembly having rollers.

Referring next to FIGS. 13, 14, 15, 16, 17 a roller based upper rack collar 320 has a square strut 310 with a vertical slot 67. The lifting nut 64 is the same as shown in FIG. 6 as is the slot 67 to accommodate the tooth 66 of nut 64. FIG. 14 shows a lowest collar 1400 resting at the base of the square strut 310. The flange 27 has a hole (not shown) through which the lowest end 1470 of the locking pin 1471 fits. The end 1470 then locks into a hole (not shown) in the base flange 26. Thus, flange 27 can rotate the square strut 310 to a desired load/unload position.

The collar 1409 has a pair of roller brackets 1480, wherein each roller bracket 1480 has a roller 1481 supported by an axle 1482. Locking nuts 1483 secure the bracket 1480 to the rectangular strut 310.

The top collar 1403 is lifted by nut 64 as in FIG. 6.

An anchor 1550 secures a rod 1551 via a nut 1552 in order to lift the next lowest collar 1402 by its anchor 1550, and this arrangement is repeated to lift lower collars 1401, 1400.

The collars 1400-1403 each have an upper saddle stop 1380. These stops 1380 brace the saddle and serve to support the collar above it against a support rod 1381, thereby preventing adjoining collars from banging against one another and/or pinching a finger between collars. About a one quarter inch gap remains between the collars when they are stacked upon each other.

Figure 15:
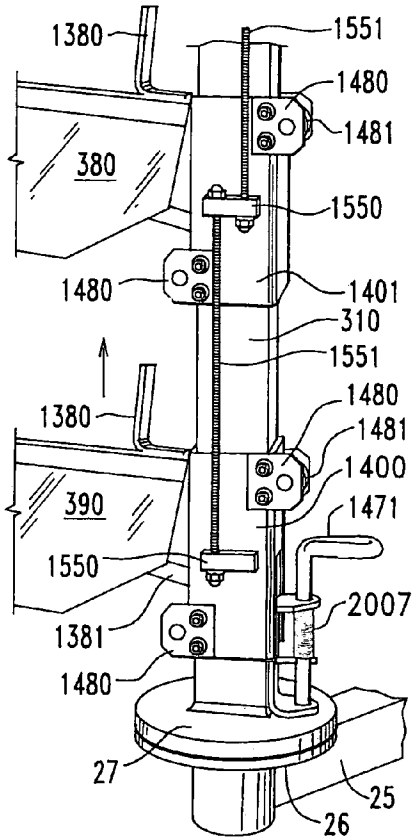
FIG. 15 is the same view as FIG. 14 with the saddle racks raised up.

Arrow UP in FIG. 15 shows the collar 1401 pulled up by its anchor 1550 via rod 1551. The saddle racks themselves (380, 390, 360) have stops 1380, a central ridge 381, and support arms 382.

Figure 18:
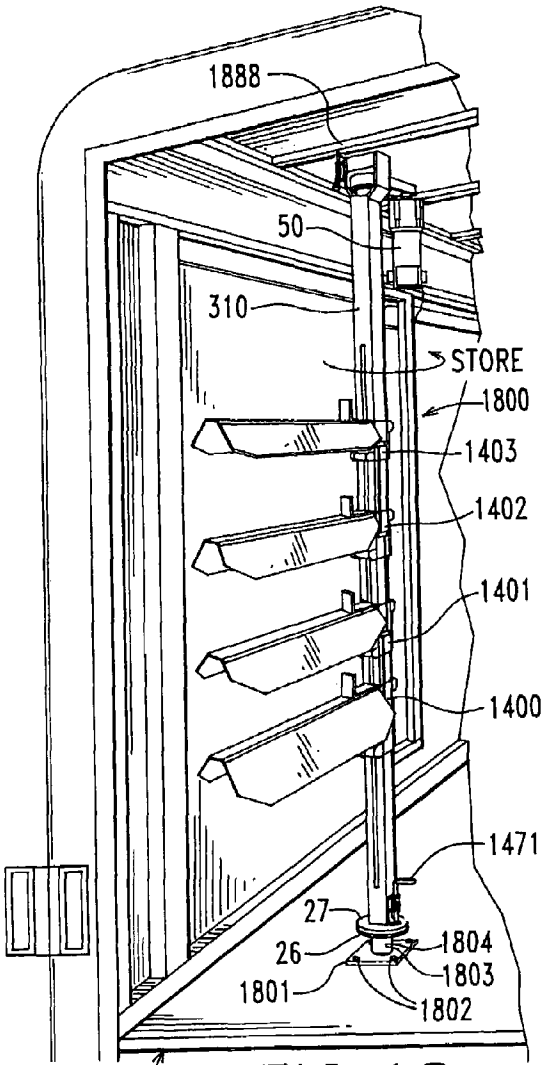
FIG. 18 is a front perspective view of an alternate embodiment rack system.
Figure 19:
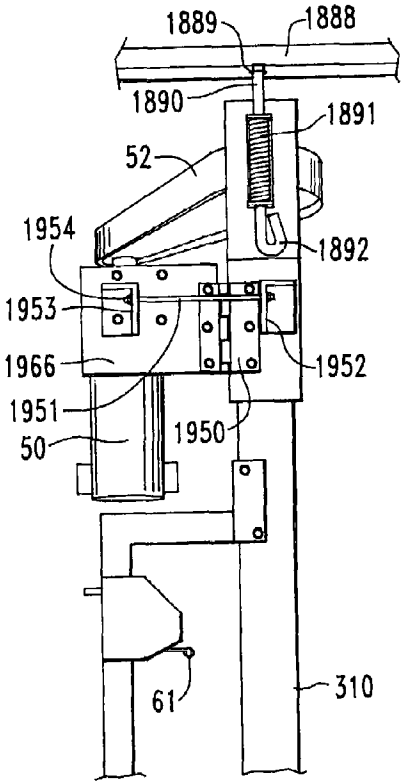
FIG. 19 is a close up side plan view of the FIG. 18 embodiment.
Figure 16:
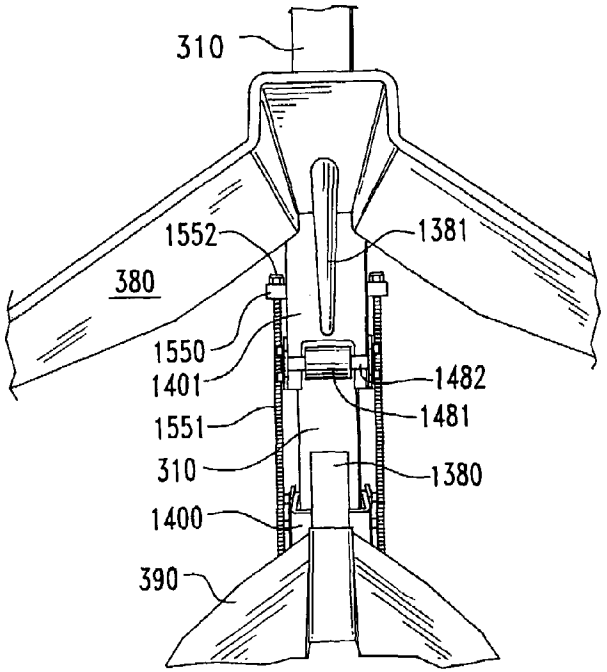
FIG. 16 is a front plan view of the roller of FIG. 13.
Figure 17:
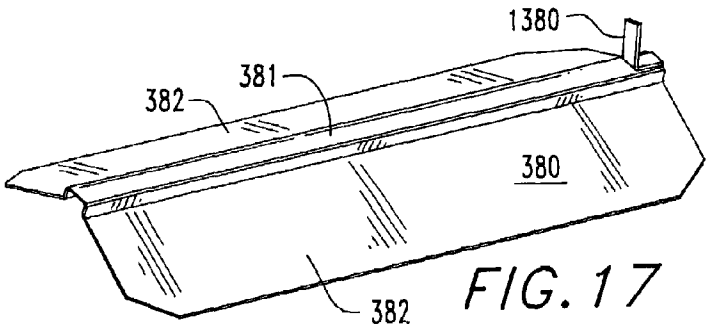
FIG. 17 is a top plan view of an alternate embodiment saddle rack.

Referring next to FIGS. 18, 19 a lower cost saddle rack 1800 doesn't have the members 13, 14, 15, 16, 18, 19, 25 of FIG. 1A. The FIGS. 13-17 members 310, 1400-1403, 26 and 27 are shown supported by a large plate 1801 with removable screws 1802. A support collar 1803 receives the post 1804 under flange 26. Thus, square strut 310 can be rotated toward the entry door 1899 as shown, and rotated per arrow STORE back away from the entry door 1899.

FIG. 19 shows how the whole assembly 1800 can be quickly removed. A locking pin 1890 is spring loaded on strut 310 via spring 1891. FIG. 19 shows the pin 1890 locked into hole 1889 in ceiling support tube 1888. Pulling pin 1890 from hole 1889 allows assembly 1800 to be lifted out of support collar 1803.

The tension of chain 52 can be adjusted by adjusting nuts 1954 on all thread rod 1951, then swinging hinge 1950 to move the motor mount 1966. Finally the nuts 1954 are locked against anchors 1952, 1953.

Figure 21:
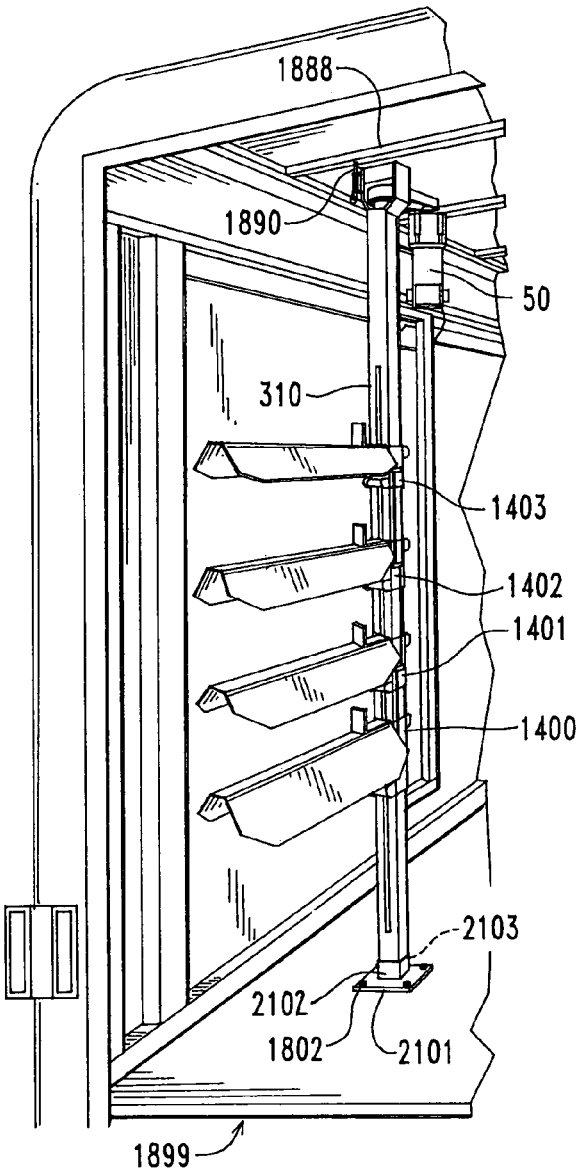
FIG. 21 is a front perspective view of a non-rotatable embodiment of a saddle rack.

Referring next to FIG. 21 the saddle rack 2100 is identical to rack 1800 of FIG. 18 except it does not swivel. Base plate 2101 has a collar 2103 that receives the bottom end of strut 310. The same pin 1890 allows the rack 2100 to be removed.

Figure 20:
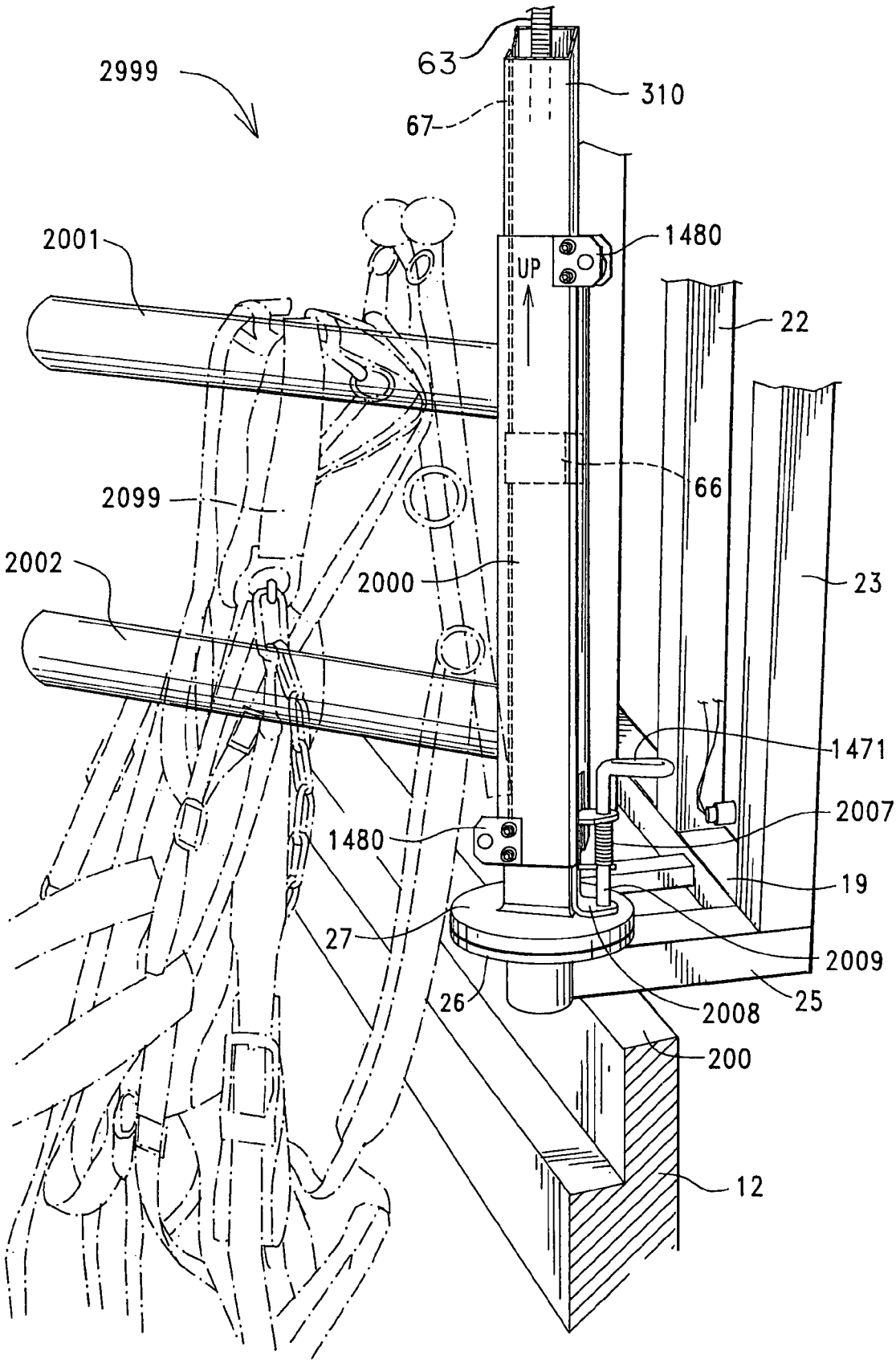
FIG. 20 is a side perspective view of a harness storage assembly.

Referring next to FIG. 20 a harness rack 2999 is shown mounted by the door ledge 200 of a trailer 12. See FIG. 1A for analogous parts. The spring 2007 and locking pin 1471, allow the strut 310 to rotate as shown in FIGS. 14, 15.

The strut 310 supports one collar 2000 with roller brackets 1480. Two posts 2001, 2002 are supported by the collar 2000. They each can carry a harness 2099 and lift them UP for storage via nut 64 and tooth 66 as in FIG. 6.

Figure 22:
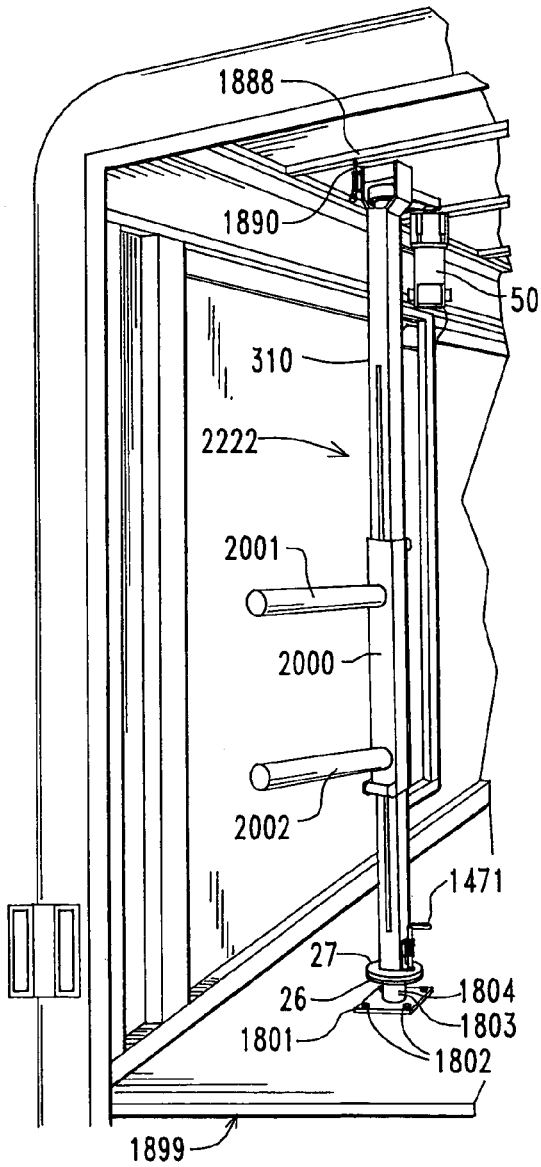
FIG. 22 is a front perspective view of a removable harness storage assembly.

Referring next to FIG. 22 a removable harness rack 2222 has the combined mounting elements of the embodiment of FIG. 18 and the collar 2000 of FIG. 20.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A saddle rack system comprising:

a first vertical support strut having an anchor means functioning to provide a base anchor for mounting on a floor;

wherein the strut can rotate in the base anchor;

a horizontal brace means attached to the first vertical support strut functioning to support a second vertical support strut having a drive means functioning to raise and lower at least one rack collar which supports a saddle rack; and wherein a user can rotate the first vertical support strut to a desired load position away from the base anchor then rotate the second vertical support strut to a desired load position, further away from the base anchor then load a saddle onto the saddle rack, then raise the saddle using the drive means, then return the first and second vertical support struts to a storage position.

2. The system of claim 1, wherein the anchor means further comprises a pair of interconnected flanges.

3. The system of claim 1, wherein the second vertical support strut further comprises a second pair of interconnected flanges mounted on the horizontal brace means.

4. The system of claim 1, wherein the drive means further comprises a motor turning a threaded rod inside the second vertical support strut, wherein a lifting nut on the threaded rod is raised and lowered, said lifting nut having a connection to the saddle rack.

5. The system of claim 4 further comprising a plurality of rack collars stacked above each other and having a linkage means functioning to pull each lower rack collar up by the adjacent upper rack collar.

6. The system of claim 5, wherein the linkage means further comprises an anchor on each saddle rack and an interconnected linkage between each set of adjacent anchors.

7. The system of claim 5, wherein the linkage means further comprises an anchor on each saddle rack and a rod slidably engaged between adjacent anchors.

8. The system of claim 1, wherein the rack collar has a limit switch contact to throw a limit switch to control the drive means.

9. The system of claim 4, wherein the connection to the saddle rack further comprises a tooth on the lifting nut which engages the rack collar.

10. The system of claim 5, wherein each saddle rack has a stop to support the adjacent top saddle rack thereon in a load mode.

11. The system of claim 5, wherein each rack collar has a roller to engage the second vertical support strut.

12. The system of claim 4, wherein the motor further comprises a sprocket for a chain connected to a sprocket on the threaded rod, said motor having a mount to the horizontal brace means.

* * * * *